US007028689B2

(12) United States Patent
Martin et al.

(10) Patent No.: US 7,028,689 B2
(45) Date of Patent: Apr. 18, 2006

(54) FILTERING FACE MASK THAT USES AN EXHALATION VALVE THAT HAS A MULTI-LAYERED FLEXIBLE FLAP

(75) Inventors: Philip G. Martin, Forest Lake, MN (US); Jianxian Xue, Maplewood, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 516 days.

(21) Appl. No.: 09/989,965

(22) Filed: Nov. 21, 2001

(65) Prior Publication Data

US 2005/0061327 A1 Mar. 24, 2005

(51) Int. Cl.
*A62B 9/02* (2006.01)
*A62B 18/10* (2006.01)

(52) U.S. Cl. ..... 128/205.24; 128/207.12

(58) Field of Classification Search ..... 128/203.11, 128/205.24, 206.15, 207.16; 137/855–858
See application file for complete search history.

(56) References Cited

U.S. PATENT DOCUMENTS

| | | | | |
|---|---|---|---|---|
| 2,072,516 A | | 3/1937 | Ferenci et al. | |
| 2,230,770 A | | 2/1941 | Van Almelo | |
| 2,895,472 A | * | 7/1959 | Matheson | 128/206.15 |

(Continued)

FOREIGN PATENT DOCUMENTS

| | | |
|---|---|---|
| EP | 0928917 A1 | 7/1999 |
| FR | 2641597 | 7/1990 |
| FR | 2688287 | 9/1993 |
| TW | 349412 | 4/1987 |

OTHER PUBLICATIONS

U.S. Appl. No. 09/888,943, filed Jun. 25, 2001, Respirator Valve.
U.S. Appl. No. 09/888,732, filed Jun. 25, 2001, Respirator Valve.
U.S. Appl. No. 09/837,800, filed Apr. 18, 2001, Filtering Face Mask That Has A New Exhalation Valve.
U.S. Appl. No. 09/837,714, filed Apr. 18, 2001, Filtering Face Mask That Has A New Exhalation Valve.
U.S. Appl. No. 09/680,465, filed Oct. 6, 2000, Fibrous Filtration Face Mask Having A New Unidirectional Fluid Valve.
U.S. Appl. No. 09/678,581, filed Oct. 3, 2000, Fibrous Filtration Face Mask Having A New Unidirectional Fluid Valve.
U.S. Appl. No. 09/678,580, filed Oct. 3, 2000, Fibrous Filtration Face Mask Having A New Unidirectional Fluid Valve.

(Continued)

*Primary Examiner*—Henry Bennett
*Assistant Examiner*—Teena Mitchell
(74) *Attorney, Agent, or Firm*—Karl G. Hanson

(57) ABSTRACT

A filtering face mask that includes a mask body and an exhalation valve. The mask body is adapted to fit at least over the nose and mouth of a wearer to create an interior gas space when worn, and the exhalation valve is in fluid communication with the interior gas space. The exhalation valve comprises a valve seat that has a seal surface and an orifice through which an exhale flow stream may pass to leave the interior gas space. A flexible flap is mounted to the valve seat such that the flap makes contact with the seal surface when the valve is in its closed position and such that the flap can flex away from the seal surface during an exhalation to allow exhaled air to pass through the orifice to ultimately enter an exterior gas space. The flexible flap has at least first and second juxtaposed layers where at least one of the layers is stiffer or has a different elastic modulus than the other layer.

86 Claims, 3 Drawing Sheets

U.S. PATENT DOCUMENTS

| | | | | | |
|---|---|---|---|---|---|
| 3,557,265 | A | | 1/1971 | Chisholm et al. | |
| 3,983,900 | A | * | 10/1976 | Airhart | 137/855 |
| 3,994,319 | A | * | 11/1976 | Airhart | 137/855 |
| 4,306,584 | A | | 12/1981 | Schlobohm | |
| 4,630,604 | A | | 12/1986 | Montesi | |
| 4,934,362 | A | | 6/1990 | Braun | |
| 5,285,816 | A | * | 2/1994 | Herlihy | 137/856 |
| 5,325,892 | A | * | 7/1994 | Japuntich et al. | 137/855 |
| 5,355,910 | A | * | 10/1994 | Gies et al. | 137/858 |
| 5,509,436 | A | | 4/1996 | Japuntich et al. | |
| 5,687,767 | A | | 11/1997 | Bowers | |
| 5,829,433 | A | * | 11/1998 | Shigematsu et al. | 128/202.28 |
| 6,047,698 | A | | 4/2000 | Magidson et al. | |
| 6,210,266 | B1 | * | 4/2001 | Barton | 454/162 |
| RE37,974 | E | * | 2/2003 | Bowers | 137/855 |
| 6,584,976 | B1 | * | 7/2003 | Japuntich et al. | 128/206.15 |

OTHER PUBLICATIONS

U.S. Appl. No. 09/678,579, filed Oct. 3, 2000, Fibrous Filtration Face Mask Having A New Unidirectional Fluid Valve.

U.S. Appl. No. 09/678,488, filed Oct. 3, 2000, Fibrous Filtration Face Mask Having A New Unidirectional Fluid Valve.

U.S. Appl. No. 09/677,637, filed Oct. 3, 2000, Fibrous Filtration Face Mask Having A New Unidirectional Fluid Valve.

U.S. Appl. No. 09/677,636, filed Oct. 3, 2000, Fibrous Filtration Face Mask Having A New Unidirectional Fluid Valve.

U.S. Appl. No. 08/240,877, filed May 11, 1994, Filtering Face Mask That Has A New Exhalation Valve.

U.S. Appl. No. 09/888,943, Respirator Valve, filed Jun. 25, 2001.

U.S. Appl. No. 09/888,732, Respirator Valve, filed Jun. 25, 2001.

U.S. Appl. No. 9/837,800, Filtering Face Mask That Has a New Exhalation Valve, Apr. 18, 2001.

U.S. Appl. No. 09/837,714, Filtering Face Mask That Has A New Exhalation Valve, Apr. 18, 2001.

U.S. Appl. No. 09/680,465, Fibrous Filtration Face Mask Having A New Undirectional Fluid Valve, filed Oct. 6, 2000.

U.S. Appl. No. 09/678,581, Fibrous Filtration Face Mask Having A New Undirectional Fluid Valve, filed Oct. 3, 2000.

U.S. Appl. No. 09/678,580, Fibrous Filtration Face Mask Having A New Undirectional Fluid Valve, filed Oct. 3, 2000.

U.S. Appl. No. 09/678,579, Fibrous Filtration Face Mask Having A New Undirectional Fluid Valve, filed Oct. 3, 2000.

U.S. Appl. No. 09/678,488, Fibrous Filtration Face Mask Having A New Undirectional Fluid Valve, filed Oct. 3, 2000.

U.S. Appl. No. 09/677,637, Fibrous Filtration Face Mask Having A New Undirectional Fluid Valve, filed Oct. 3, 2000.

U.S. Appl. No. 09/677,636, Fibrous Filtration Face Mask Having A New Undirectional Fluid Valve, filed Oct. 3, 2000.

U.S. Appl. No. 08/240,877, Filtering Face Mask That Has A New Exhalation Valve, filed May 11, 1994.

* cited by examiner

FILTERING FACE MASK THAT USES AN EXHALATION VALVE THAT HAS A MULTI-LAYERED FLEXIBLE FLAP

The present invention pertains to a filtering face mask that uses a multi-layered flexible flap as the dynamic mechanical element in its exhalation valve, or its inhalation valve.

BACKGROUND

Persons who work in polluted environments commonly wear a filtering face mask to protect themselves from inhaling airborne contaminants. Filtering face masks typically have a fibrous or sorbent filter that is capable of removing particulate and/or gaseous contaminants from the air. When wearing a face mask in a contaminated environment, wearers are comforted with the knowledge that their health is being protected, but they are, however, contemporaneously discomforted by the warm, moist, exhaled air that accumulates around their face. The greater this facial discomfort is, the greater the chances are that wearers will remove the mask from their face to alleviate the unpleasant condition.

To reduce the likelihood that a wearer will remove the mask from their face in a contaminated environment, manufacturers of filtering face masks often install an exhalation valve on the mask body to allow the warm, exhaled moist, air to be rapidly purged from the mask interior. The rapid removal of the exhaled air makes the mask interior cooler, and, in turn, benefits worker safety because mask wearers are less likely to remove the mask from their face to eliminate the hot moist environment that is located around their nose and mouth.

For many years, commercial manufacture respiratory masks have used installed "button-style" exhalation valves on the masks enable exhaled air to be purged from the mask interiors. The button-style valves typically have employed a thin circular flexible flap as the dynamic mechanical element that lets exhaled air escape from the mask interior. The flap is centrally mounted to a valve seat through a central post. Examples of button-style valves are shown in U.S. Pat. Nos. 2,072,516, 2,230,770, 2,895,472, and 4,630,604. When a person exhales, a circumferential portion of the flap is lifted from the valve seat to allow air to escape from the mask interior.

Button-style valves have represented an advance in the attempt to improve wearer comfort, but investigators have made other improvements, an example of which is shown in U.S. Pat. No. 4,934,362 to Braun. The valve described in this patent uses a parabolic valve seat and an elongated flexible flap. Like the button-style valve, the Braun valve also has a centrally-mounted flap and has a flap edge portion that lifts from a seal surface during an exhalation to allow the exhaled air to escape from the mask interior.

After the Braun development, another innovation was made in the exhalation valve art by Japuntich et al.—see U.S. Pat. Nos. 5,325,892 and 5,509,436. The Japuntich et al. valve uses a single flexible flap that is mounted off-center in cantilevered fashion to minimize the exhalation pressure that is required to open the valve. When the valve-opening pressure is minimized, less power is required to operate the valve, which means that the wearer does not need to work as hard to expel exhaled air from the mask interior when breathing.

Other valves that have been introduced after the Japuntich et al. valve also have used a non-centrally mounted cantilevered flexible flap—see U.S. Pat. Nos. 5,687,767 and 6,047,698. Valves that have this kind of construction are sometimes referred to as "flapper-style" exhalation valves.

In known valve products, like the exhalation valves described above, the flexible flap has had a monolithic construction. For example, the flexible flap that is described in the '362 patent to Braun is made of pure gum rubber, and the flap that is described in the Japuntich et al. patents is made solely from an elastomeric material such as a crosslinked natural rubber (for example, crosslinked polyisoprene) or a synthetic elastomer such as neoprene, butyl rubber, nitrile rubber, or silicone rubber.

Although known exhalation valve products have been successful at improving wearer comfort by encouraging exhaled air to leave the mask interior, none of the known valve products have used flexible flaps that are made from multiple layers of different material components, which as described below may provide further benefits towards improving valve performance and hence wearer comfort.

SUMMARY OF THE INVENTION

The present invention provides a new filtering face mask, which in brief summary, comprises: (a) a mask body that is adapted to fit at least over the nose and mouth of a wearer to create an interior gas space when worn; and (b) an exhalation valve that is in fluid communication with the interior gas space. The exhalation valve comprises: (i) a valve seat that includes a seal surface and an orifice through which exhaled air may pass to leave the interior gas space; and (ii) a flexible flap that is mounted to the valve seat such that the flap makes contact with the seal surface when the valve is in its closed position and such that the flap can flex away from the seal surface during an exhalation to allow exhaled air to pass through the orifice. The flexible flap includes first and second juxtaposed layers where at least one of the layers is stiffer or has a greater modulus of elasticity than the other layer.

The inventors discovered that the use of a multi-layered flexible flap in a unidirectional fluid valve can provide performance benefits to an exhalation valve for a filtering face mask. In particular, the inventors discovered that a thinner and more dynamic flexible flap may be used in some instances, which can allow the valve to open easier under less pressure drop to enable warm, moist, exhaled air to escape from the mask interior under less exhalation pressure. Wearers therefore may be able to purge larger amounts of exhaled air from the interior gas space more rapidly without expending as much power, resulting in improved comfort to the mask wearer.

The inventors also discovered that a larger process window may be available to manufacturers of the flaps for exhalation valves. When making flapper-style exhalation valves, the thickness and stiffness of the flap material generally needs to be carefully controlled so that the appropriate beam stiffness can be achieved for the flap-otherwise, the valve may be subject to leakage at the point where the flap contacts the valve's seal surface. When making a multi-layered flap of the present invention, however, flap-to-flap variability may not need to be so tightly controlled during the manufacturing process because one layer in the flap can be easily fashioned to provide the flap with its desired beam stiffness. Overall flap thickness tolerances then do not need to be so tightly controlled during manufacture. The structure and benefits of the new exhalation valve may also be applied to an inhalation valve, where the flow through the valve is likewise unidirectional and where improvements in pressure drop across the valve are similarly beneficial to wearer comfort.

GLOSSARY

The terms used to describe this invention will have the following meanings:

"clean air" means a volume of air or oxygen that has been filtered to remove contaminants or that otherwise has been made safe to breathe;

"closed position" means the position where the flexible flap is in full contact with the seal surface;

"contaminants" mean particles and/or other substances that generally may not be considered to be particles (e.g., organic vapors, et cetera) but may be suspended in air;

"exhaled air" is air that is exhaled by a filtering face mask wearer;

"exhale flow stream" means the stream of air that passes through an orifice of an exhalation valve during an exhalation;

"exhalation valve" means a valve that is adapted for use on a filtering face mask to allow a fluid to exit a filtering face mask's interior gas space when the valve is operatively disposed on the mask;

"exterior gas space" means the ambient atmospheric gas space into which exhaled gas enters after passing through and beyond the exhalation valve;

"filtering face mask" means a respiratory protection device (including half and full face masks and hoods) that covers at least the nose and mouth of a wearer and that is capable of supplying clean air to a wearer;

"flexible flap" means a sheet-like article that is capable of bending or flexing in response to a force exerted from a moving fluid, which moving fluid, in the case of an exhalation valve, would be an exhale flow stream and in the case of an inhalation valve would be an inhale flow stream;

"flexural modulus" means the ratio of stress to strain for a material loaded in a bending mode.

"inhale filter element" means a fluid-permeable structure through which air passes before being inhaled by a wearer of a filtering face mask so that contaminants and/or particles can be removed therefrom;

"inhale flow stream" means the stream of air or oxygen that passes through an orifice of an inhalation valve during an inhalation;

"inhalation valve" means a valve that opens to allow a fluid to enter a filtering face mask's interior gas space;

"interior gas space" means the space between a mask body and a person's face;

"juxtaposed" means placed side-by-side but not necessarily in contact with each other;

"mask body" means a structure that can fit at least over the nose and mouth of a person and that helps define an interior gas space separated from an exterior gas space;

"modulus of elasticity" means the ratio of the stress to the strain for the straight line portion of the stress/strain curve that is obtained by applying an axial load to a test specimen and measuring the load and deformation simultaneously through use of a tensile testing machine;

"moduli ratio" means the ratio of the modulus of elasticity values, for the materials forming the flexible flap, as expressed by a fraction where the more flexible layer is placed in the numerator. Thus, in a preferred embodiment, the value of the modulus of elasticity of a first layer, which preferably contacts the valve seat and is more flexible, would be the numerator of the fraction, and the denominator would be the modulus of elasticity of the second stiffer layer, which is juxtapositioned to the first layer, either directly or through other layers;

"particles" mean any liquid and/or solid substance that is capable of being suspended in air, for example, pathogens, bacteria, viruses, mucous, saliva, blood, etc.;

"seal surface" means a surface that makes contact with the flexible flap when the valve is in its closed position;

"stiff or stiffness" means the layer's ability to resist deflection when supported horizontally as a cantilever by itself without support from other layers and exposed to gravity. A stiffer layer does not deflect as easily in response to gravity as a layer that is not as stiff;

"unidirectional fluid valve" means a valve that allows a fluid to pass through it in one direction but not the other.

DETAILED DESCRIPTION OF PREFERRED EMBODIMENTS

In the practice of the present invention, a new filtering face mask is provided that may improve wearer comfort and concomitantly make it more likely that users will continuously wear their masks in contaminated environments. The present invention thus may improve worker safety and provide long term health benefits to workers and others who wear personal respiratory protection devices.

Figure 1:
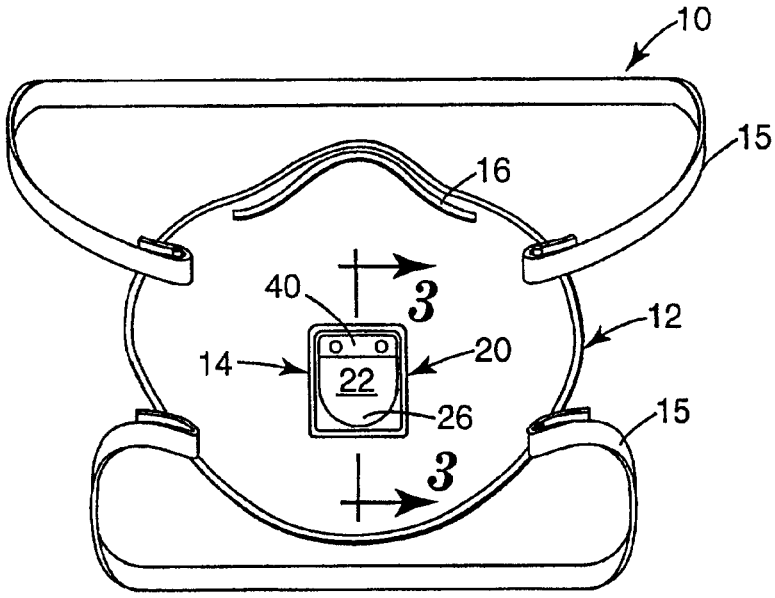
FIG. 1 is a front view of a filtering face mask 10 that may be used in connection with the present invention.

FIG. 1 illustrates an example of a filtering face mask 10 that may be used in conjunction with the present invention. Filtering face mask 10 has a cup-shaped mask body 12 onto which an exhalation valve 14 is attached. The valve may be attached to the mask body using any suitable technique, including, for example, the technique described in U.S. Pat. No. 6,125,849 to Williams et al. or in WO 01/28634 to Curran et al. The exhalation valve 14 opens in response to increased pressure inside the mask 10, which increased pressure occurs when a wearer exhales. The exhalation valve 14 preferably remains closed between breaths and during an inhalation.

Mask body 12 is adapted to fit over the nose and mouth of a person in spaced relation to the wearer's face to create an interior gas space or void between the wearer's face and the interior surface of the mask body. The mask body 12 is fluid permeable and typically is provided with an opening (not shown) that is located where the exhalation valve 14 is attached to the mask body 12 so that exhaled air can exit the interior gas space through the valve 14 without having to pass through the mask body 12. The preferred location of the opening on the mask body 12 is directly in front of where the wearer's mouth would be when the mask is being worm. The placement of the opening, and hence the exhalation valve 14, at this location allows the valve to open more easily in response to the exhalation pressure generated by a wearer of the mask 10. For a mask body 12 of the type shown in this FIG. 1, essentially the entire exposed surface of mask body 12 is fluid permeable to inhaled air.

A nose clip 16 that comprises a pliable dead soft band of metal such as aluminum can be provided on mask body 12 to allow it to be shaped to hold the face mask in a desired fitting relationship over the nose of the wearer. An example of a suitable nose clip is shown in U.S. Pat. Nos. 5,558,089 and Des. 412,573 to Castiglione.

Mask body 12 can have a curved, hemispherical shape as shown in FIG. 1 (see also U.S. Pat. No. 4,807,619 to Dyrud et al.) or it may take on other shapes as so desired. For example, the mask body can be a cup-shaped mask having a construction like the face mask disclosed in U.S. Pat. No. 4,827,924 to Japuntich. The mask also could have the three-fold configuration that can fold flat when not in use but can open into a cup-shaped configuration when worn—see U.S. Pat. No. 6,123,077 to Bostock et al., and U.S. Pat. Nos. Des. 431,647 to Henderson et al., Des. 424,688 to Bryant et al. Face masks of the invention also may take on many other configurations, such as flat bifold masks disclosed in U.S. Pat. No. Des. 443,927 to Chen. The mask body also could be fluid impermeable and have filter cartridges attached to it like the mask shown in U.S. Pat. No. 5,062,421 to Burns and Reischel. In addition, the mask body also could be adapted for use with a positive pressure air intake as opposed to the negative pressure masks just described. Examples of positive pressure masks are shown in U.S. Pat No. 5,924,420 to Grannis et al. and 4,790,306 to Braun et al. The mask body of the filtering face mask also could be connected to a self-contained breathing apparatus, which supplies clean air to the wearer as disclosed, for example, in U.S. Pat. Nos. 5,035,239 and 4,971,052. The mask body may be configured to cover not only the nose and mouth of the wearer (referred to as a "half mask" ) but may also cover the eyes (referred to as a "full face mask") to provide protection to a wearer's vision as well as to the wearer's respiratory system—see, for example, U.S. Pat. No. 5,924,420 to Reischel et al. The mask body may be spaced from the wearer's face, or it may reside flush or in close proximity to it. In either instance, the mask helps define an interior gas space into which exhaled air passes before leaving the mask interior through the exhalation valve. The mask body also could have a thermochromic fit-indicating seal at its periphery to allow the wearer to easily ascertain if a proper fit has been established—see U.S. Pat. No. 5,617,849 to Springett et al.

To hold the face mask snugly upon the wearer's face, mask body can have a harness such as straps 15, tie strings, or any other suitable means attached to it for supporting the mask on the wearer's face. Examples of mask harnesses that may be suitable are shown in U.S. Pat. Nos. 5,394,568, and 6,062,221 to Brostrom et al., and U.S. Pat. No. 5,464,010 to Byram.

Figure 2:
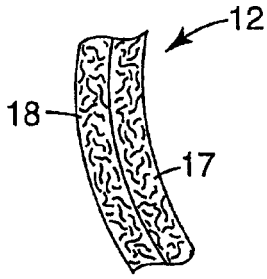
FIG. 2 is a partial cross section of the mask body 12 in FIG. 1.

FIG. 2 shows that the mask body 12 may comprise multiple layers such as an inner shaping layer 17 and an outer filtration layer 18. Shaping layer 17 provides structure to the mask body 12 and support for filtration layer 18. Shaping layer 17 may be located on the inside and/or outside of filtration layer 18 (or on both sides) and can be made, for example, from a nonwoven web of thermally—bondable fibers molded into a cup-shaped configuration-see 4,807,619 to Dyrud et al. and U.S. Pat. No. 4,536,440 to Berg. It can also be made from a porous layer or an open work "fishnet" type network of flexible plastic like the shaping layer disclosed in U.S. Pat. No. 4,850,347 to Skov. The shaping layer can be molded in accordance with known procedures such as those described in Skov or in U.S. Pat. No. 5,307,796 to Kronzer et al. Although a shaping layer 17 is designed with the primary purpose of providing structure to the mask and providing support for a filtration layer, shaping layer 17 also may act as a filter typically for capturing larger particles. Together layers 17 and 18 operate as an inhale filter element.

When a wearer inhales, air is drawn through the mask body, and airborne particles become trapped in the interstices between the fibers, particularly the fibers in the filter layer 18. In the mask shown in FIG. 2, the filter layer 18 is integral with the mask body 12—that is, it forms part of the mask body and is not an item that subsequently becomes attached to (or removed from) the mask body like a filter cartridge.

Filtering materials that are commonplace on negative pressure half mask respirators—like the mask 10 shown in FIG. 1—often contain an entangled web of electrically charged microfibers, particularly meltblown microfibers (BMF). Microfibers typically have an average effective fiber diameter of about 20 micrometers (μm) or less, but commonly are about 1 to about 15 μm, and still more commonly be about 3 to 10 μm in diameter. Effective fiber diameter may be calculated as described in Davies, C. N., *The Separation of Airborne Dust and Particles,* Institution of Mechanical Engineers, London, Proceedings 1B. 1952. BMF webs can be formed as described in Wente, Van A., *Superfine Thermoplastic Fibers in Industrial Engineering Chemistry,* vol. 48, pages 1342 et seq. (1956) or in Report No. 4364 of the Naval Research Laboratories, published May 25, 1954, entitled *Manufacture of Superfine Organic Fibers* by Wente, Van A., Boone, C. D., and Fluharty, E. L. When randomly entangled in a web, BMF webs can have sufficient integrity to be handled as a mat. Electric charge can be imparted to fibrous webs using techniques described in, for example, U.S. Pat. No. 5,496,507 to Angadjivand et al., U.S. Pat. No. 4,215,682 to Kubik et al., and U.S. Pat. No. 4,592,815 to Nakao.

Examples of fibrous materials that may be used as filters in a mask body are disclosed in U.S. Pat. No. 5,706,804 to Baumann et al., U.S. Pat. No. 4,419,993 to Peterson, U.S. Reissue Pat. No. Re 28,102 to Mayhew, U.S. Pat. Nos. 5,472,481 and 5,411,576 to Jones et al., and U.S. Pat. No. 5,908,598 to Rousseau et al. The fibers may contain polymers such as polypropylene and/or poly4-methyl-1-pentene (see U.S. Pat. Nos. 4,874,399 to Jones et al. and 6,057,256 to Dyrud et al.) and may also contain fluorine atoms and/or other additives to enhance filtration performance—see, U.S. patent application Ser. No. 09/109,497, entitled *Fluorinated Electret* (published as PCT WO 00/01737), and U.S. Pat. Nos. 5,025,052 and 5,099,026 to Crater et al., and may also have low levels of extractable hydrocarbons to improve performance; see, for example, U.S. Pat. No. 6,213,122 to Rousseau et al. Fibrous webs also may be fabricated to have increased oily mist resistance as described in U.S. Pat. No. 4,874,399 to Reed et al., and in U.S. Pat. Nos. 6,238,466 and 6,068,799, both to Rousseau et al.

A mask body 12 may also include inner and/or outer cover webs (not shown) that can protect the filter layer 18 from abrasive forces and that can retain any fibers that may come loose from the filter layer 18 and/or shaping layer 17. The cover webs also may have filtering abilities, although typically not nearly as good as the filtering layer 18 and/or may serve to make the mask more comfortable to wear. The cover webs may be made from nonwoven fibrous materials such as spun bonded fibers that contain, for example, polyolefins, and polyesters (see, for example, U.S. Pat. Nos. 6,041,782 to Angadjivand et al.), 4,807,619 to Dyrud et al., and 4,536,440 to Berg.

Figure 3:
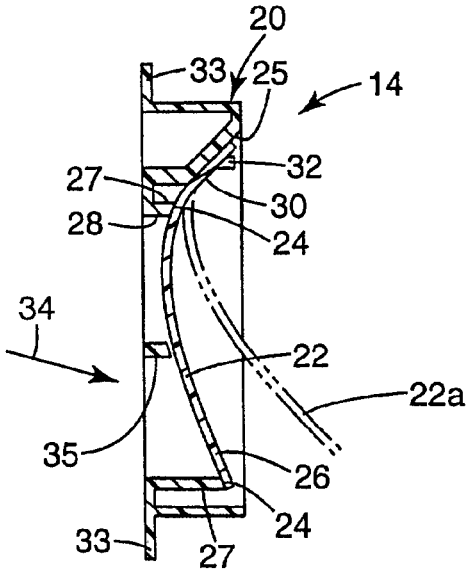
FIG. 3 is a cross-sectional view of an exhalation valve 14, taken along lines 3—3 of FIG. 1.

FIG. 3 shows that the flexible flap 22 rests on a seal surface 24 when the flap is closed and is also supported in cantilevered fashion to the valve seat 20 at a flap-retaining surface 25. The flap 22 lifts from the seal surface 24 at its free end 26 when a significant pressure is reached in the interior gas space during an exhalation. The seal surface 24 can be configured to generally curve in the longitudinal dimension in a concave cross-section when viewed from a side elevation and may be non-aligned and relatively positioned with respect to a flap-retaining surface 25 to allow the flap to be biased or pressed towards the seal surface under neutral conditions—that is, when a wearer is neither inhaling or exhaling. The seal surface 24 may reside at the extreme end of a seal ridge 27. The flap can also have a transverse curvature imparted to it as described in U.S. Pat. No. 5,687,767, reissued as Re 37974 to Bowers.

When a wearer of a filtering face mask 10 exhales, the exhaled air commonly passes through both the mask body and the exhalation valve 14. Comfort is best obtained when the highest percentage of the exhaled air passes through the exhalation valve 14, as opposed to the filter media and/or shaping and cover layers in the mask body. Exhaled air is expelled from the interior gas space through an orifice 28 in valve 14 by having the exhaled air lift the flexible flap 22 from the seal surface 24. The circumferential or peripheral edge of flap 22 that is associated with a fixed or stationary portion 30 of the flap 22 remains essentially stationary during an exhalation, while the remaining free circumferential edge of flexible flap 22 is lifted from valve seat 20 during an exhalation.

The flexible flap 22 is secured at the stationary portion 30 to the valve seat 20 on the flap retaining surface 25, which surface 25 is disposed non-centrally relative to the orifice 28 and can have pins 32 to help mount and position the flap 22 on the valve seat 20. Flexible flap 22 can be secured to the surface 25 using sonic welding, an adhesive, mechanical clamping, and the like. The valve seat 20 also has a flange 33 that extends laterally from the valve seat 20 at its base to provide a surface that allows the exhalation valve 14 to be secured to the mask body 12.

FIG. 3 shows the flexible flap 22 in a closed position resting on seal surface 24 and in an open position by the dotted lines 22*a*. A fluid passes through the valve 14 in the general direction indicated by arrow 34. If valve 14 was used on a filtering face mask to purge exhaled air from the mask interior, fluid flow 34 would represent an exhale flow stream. If valve 14 was used as an inhalation valve, flow stream 34 would represent an inhale flow stream. The fluid that passes through orifice 28 exerts a force on the flexible flap 22, causing the free end 26 of flap 22 to be lifted from seal surface 24 to make the valve 14 open. When valve 14 is used as an exhalation valve, the valve is preferably oriented on face mask 10 such that the free end 26 of flexible flap 24 is located below the secured end when the mask 10 is positioned upright as shown in FIG. 1. This enables exhaled air to be deflected downwards to prevent moisture from condensing on the wearer's eyewear.

Figure 4:
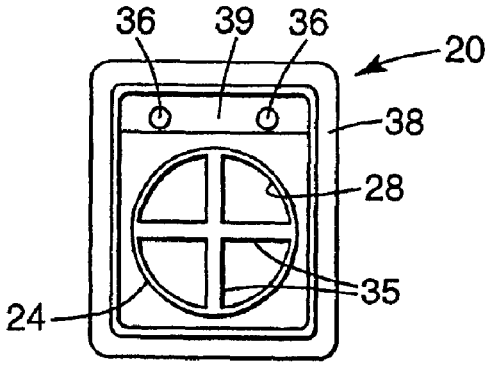
FIG. 4 is a front view of a valve seat 20 that may be used in conjunction with the present invention.

FIG. 4 shows the valve seat 20 from a front view without a flap being attached to it. The valve orifice 28 is disposed radially inward from the seal surface 24 and can have cross members 35 that stabilize the seal surface 24 and ultimately the valve 14. The cross members 35 also can prevent flap 22 (FIG. 3) from inverting into orifice 28 during an inhalation. Moisture build-up on the cross members 35 can hamper the opening of the flap 22. Therefore, the surfaces of the cross-members 35 that face the flap preferably are slightly recessed beneath the seal surface 24 when viewed from a side elevation to not hamper valve opening.

The seal surface 24 circumscribes or surrounds the orifice 28 to prevent the undesired passage of contaminates through it. Seal surface 24 and the valve orifice 28 can take on essentially any shape when viewed from the front. For example, the seal surface 24 and the orifice 28 may be square, rectangular, circular, elliptical, etc. The shape of seal surface 24 does not have to correspond to the shape of orifice 28 or vise versa. For example, the orifice 28 may be circular and the seal surface 24 may be rectangular. The seal surface 24 and orifice 28, however, preferably have a circular cross-section when viewed against the direction of fluid flow.

Valve seat 20 preferably is made from a relatively lightweight plastic that is molded into an integral one-piece body. The valve seat 20 can be made by injection molding techniques. The seal surface 24 that makes contact with the flexible flap 22 is preferably fashioned to be substantially uniformly smooth to ensure that a good seal occurs and may reside on the top of a seal ridge. The contact surface 24 preferably has a width great enough to form a seal with the flexible flap 22 but is not so wide as to allow adhesive forces caused by condensed moisture to make the flexible flap 22 significantly more difficult to open. The width of the seal or contact surface, preferably, is at least 0.2 mm, and preferably is about 0.25 mm to 0.5 mm. The valve 14 and its valve seat 20 shown in FIGS. 1, 3 and 4 are more fully described in U.S. Pat. Nos. 5,509,436 and 5,325,892 to Japuntich et al.

Figure 5:
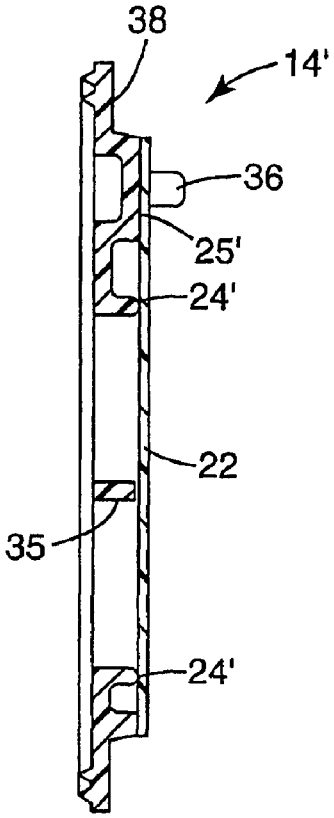
FIG. 5 is a side view of an alternative embodiment of an exhalation valve 14' that may be used on a filtering face mask in accordance with the present invention.

FIG. 5 shows another embodiment of an exhalation valve 14'. Unlike the embodiment shown in FIG. 3, this exhalation valve has, when viewed from a side elevation, a planar seal surface 24' that is in alignment with the flap-retaining surface 25'. The flap shown in FIG. 5 thus is not pressed towards or against the seal surface 24' by virtue of any mechanical force or internal stress that is placed on the flexible flap 22. Because the flap 22 is not biased towards the seal surface 24' under neutral conditions (that is, when no fluid is passing through the valve or the flap is not otherwise subjected to external forces), the flap 22 can open more easily during an exhalation. When using a multi-layered flexible flap in accordance with the present invention, it may not be necessary to have the flap biased or forced into contact with the seal surface 24'-although such a construction may be desired in some instances. The use of a stiffer layer in the flexible flap can stiffen the whole flap so that it does not significantly droop away from the seal surface 24' when a force of gravity is exerted upon the flap. The exhalation valve 14' shown in FIG. 5 thus can be fashioned so that the flap 22 makes good contact with the seal surface under any orientation, including when a wearer bends their head downward towards the floor, without having the flap biased (or substantially biased) towards the seal surface. A multi-layered flap of the present invention, therefore, may make hermetic-type contact with the seal surface 24' under any orientation of the valve with very little or no pre-stress or bias towards the valve seat's seal surface. The lack of significant predefined stress or force on the flap, to ensure that it is pressed against the seal surface during valve closure under neutral conditions, can enable the flap to open more easily during an exhalation and hence can reduce the power needed to operate the valve while breathing.

Figure 6:
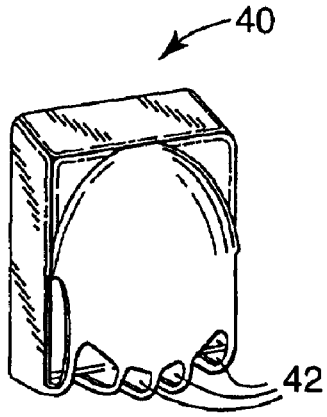
FIG. 6 is a perspective view of a valve cover 40 that may be used to protect an exhalation valve.

FIG. 6 shows a valve cover 40 that may be suitable for use in connection with the exhalation valves shown in the other figures. The valve cover 40 defines an internal chamber into which the flexible flap can move from its closed position to its open position. The valve cover 40 can protect the flexible flap from damage and can assist in directing exhaled air downward away from a wearer's eyeglasses. As shown, the valve cover 40 may possess a plurality of openings 42 to allow exhaled air to escape from the internal chamber defined by the valve cover. Air that exits the internal chamber through the openings 42 enters the exterior gas space, downwardly away from a wearer's eyewear.

Although the present invention has been described with reference to a flapper-style exhalation valve, the invention is similarly suitable for use with other kinds of valves such as the button-style valves discussed above in the Background. In addition, the present invention is likewise suitable for use in conjunction with an inhalation valve. Like an exhalation valve, an inhalation valve also is a unidirectional fluid valve that provides for fluid transfer between an exterior gas space and an interior gas space. Unlike an exhalation valve, however, an inhalation valve allows air to enter the interior of a mask body. An inhalation valve thus allows air to move from an exterior gas space to the interior gas space during an inhalation.

Inhalation valves are commonly used in conjunction with filtering face masks that have filter cartridges attached to them. The valve may be second to either the filter cartridge or to the mask body. In any case, the inhalation valve is preferably disposed in the inhale flow stream downstream to where the air has been filtered or otherwise has been made safe to breathe. Examples of commercially available masks that include inhalation valves are the 5000® and 6000® Series respirators sold by the 3M Company. Patented examples of filtering face masks that use an inhalation valve are disclosed in U.S. Pat. No. 5,062,421 to Burns and Reischel, U.S. Pat. No. 6,216,693 to Rekow et al., and in U.S. Pat. No. 5,924,420 to Reischel et al. (see also U.S. Pat. Nos. 6,158,429, 6,055,983, and 5,579,761). While the inhalation valve could take, for example, the form of a button-style valve, alternatively, it could also be a flapper-style valve like the valve shown in FIGS. 1, 3, 4, and 5. To use the valve shown in these figures as an inhalation valve, it merely needs to be mounted to the mask body in an inverted fashion so that the flexible flap 22 lifts from the seal surface 24 or 24' during an inhalation rather than during an exhalation. The flap 22 thus, would be pressed against the seal surface 24, 24' during an exhalation rather than an inhalation. An inhalation valve of the present invention could similarly improve wearer comfort by reducing the power needed to operate the inhalation valve while breathing.

As discussed above, a flexible flap that is constructed for use in a fluid valve of the invention comprises a sheet that is shaped and adapted for attachment to a valve seat of a fluid valve. The flexible flap can bend dynamically in response to a force from a moving gaseous flowstream and can readily return to its original position when the force is removed. The sheet comprises first and second juxtaposed layers where at least one of the layers is stiffer than the other or has an elastic modulus than the other.

Figure 7:
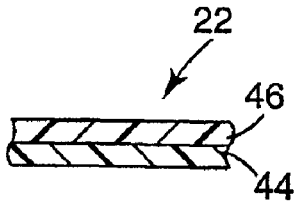
FIG. 7 is a partial cross-sectional side view of a multi-layered flexible flap 22 in accordance with the present invention.

FIG. 7 shows a flexible flap 22—which may be used with valves and face masks in accordance with the present invention—in an enlarged cross-section so that the multi-layered flap construction can be seen. As shown, the flap 22 has first and second juxtaposed layers 44 and 46, respectively. The layers 44 and 46 are preferably securely bonded together to provide resistance to shearing between layers, but the individual layers do not need to be bonded together at their interface, i.e., the layers may float relative to each other as, for example, in a leaf spring. The layers 44 and 46 may be formed of materials that deform elastically over the actuation range of the flexible flap. When secured to the valve, the first layer 44 preferably is disposed on the side of the flap 22 that faces the valve seat's seal surface (24, 24' FIGS. 1, 3, 4, and 5) when the valve is in its closed position. The flap's second layer 46 preferably is disposed away from the seal surface (relative to the first layer) towards the inside surface of the top of the valve cover (FIG. 6). The first and second layers 44, 46 are preferably constructed from materials that exhibit different moduli of elasticity.

Figure 8:
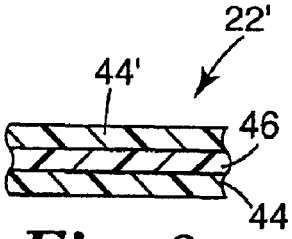
FIG. 8 is a partial cross-sectional side view of an alternative embodiment of a multi-layered flexible flap 22' in accordance with the present invention.

FIG. 8 shows another embodiment of a flexible flap 22' that has a multi-layered construction in accordance with the present invention. In this embodiment, the flexible flap has first, second, and third layers 44, 46, and 44', respectively. The first and third layers 44 and 44' can have the same or very similar stiffness and/or modulus of elasticity, and the second layer differs in stiffness and/or modulus of elasticity from the first and third layers as described above. This multi-layered construction thus can display symmetry or substantial symmetry with respect to the central second layer 46. A symmetrical or substantially symmetrical flap may be preferred because the symmetry may prevent the flap from curling or having a tendency to curl.

The modulus of elasticity may be important in designing a flexible flap according to the invention. As indicated above, the "modulus of elasticity" is the ratio of the stress-to-strain for the straight-line portion of the stress-strain curve, which curve is obtained by applying an axial load to a test specimen and measuring the load and deformation simultaneously. Typically, a test specimen is loaded uniaxially and load and strain are measured, either incrementally or continuously. The modulus of elasticity for materials employed in the invention may be obtained using a standardized ASTM test. The ASTM tests employed for determining elastic or Young's modulus are defined by the type or class of material that is to be analyzed under standard conditions. A general test for structural materials is covered by ASTM E111-97 and may be employed for structural materials in which creep is negligible, compared to the strain produced immediately upon loading and to elastic behavior. The standard test method for determining tensile properties of plastics is described in ASTM D638-01 and may be employed when evaluating unreinforced and reinforced plastics. If a vulcanized thermoset rubber or thermoplastic elastomer is selected for use in the invention, then standard test method ASTM D412-98a, which covers procedures used to evaluate the tensile properties of these materials, may be employed. If a glass or glass-ceramic material is employed in a layer of the flap of the invention, then standard test method ASTM C623-92 may be employed.

Flexural modulus is another property that may be used to define the material used in the layers of the flexible flap. Moduli ratios for flexural modulus would be similar to, and preferably are the same as, moduli ratios for the elastic modulus. For plastics, flexural modulus may be determined in accordance with standardized test ASTM D747-99.

It is important to realize that modulus values convey intrinsic material properties and not precisely-comparable composition properties. This is especially true when dissimilar classes of materials are employed in different layers. When this happens, it is the value of the modulus for each layer that is important, even though the test methods may not be directly comparable. When materials of the same class are employed in each flap layer then, if possible, a common test method may be employed to evaluate the modulus of the materials. And if different classes of materials are employed in a single layer, then the skilled artisan will need to select the test that is most appropriate for the combination of materials. For example, if a flap layer contains a ceramic powder in a polymer, the ASTM test for plastics would probably be the more suitable test method if the plastic portion was the continuous phase in the layer.

When evaluating properties such as stiffness, elastic modulus, and flexural modulus, it generally will not be possible to evaluate these parameters for each flap layer while in the flap itself. The evaluator will need to ascertain the composition of each layer, and test that composition for stiffness and modulus. The relative stiffness of each layer can be arrived at by reproducing a layer of material and supporting it horizontally at one end. Another layer of material of the same size and construction is supported the same way. The amount of deflection of each layer is measured. When evaluating modulus, an appropriate test method is selected, which test method allows the stress-to-strain ratio to be determined for the straight-line portion of the stress-strain curve.

The flexible flap's second layer 46 is preferably made from a material that has a modulus of elasticity that is greater than the modulus of elasticity of the first layer. The modulus of elasticity of the first layer 44 preferably is about 0.15 to 10 mega Pascals (MPa), more preferably 1 to 7 MPa, and still more preferably 2 to 5 MPa. The modulus of elasticity of the second layer preferably is about 2 to $1.1\times^{6}$ MPa, more preferably is about 200 to 11,000 MPa, and still more preferably is about 300 to 5,000 MPa. The moduli ratio, between the first layer and second layer, preferably is less than one, more preferably less than 0.01, and still more preferably less than 0.001. Values for the moduli ratio useful for applications of the invention may be as small as 0.0000001.

Regardless of the number of material layers in the construction, the flexible flap's overall thickness may typically be about 10 to 2000 micrometers (μm), preferably about 20 to 700 μm, and more preferably about 25 to 600 μm. The first layer, which is the more flexible layer, and preferably softer layer, typically has a thickness of about 5 to 700 μm, preferably about 10 to 600 μm, and more preferably about 12 to 500 μm. The second, stiffer layer typically has a thickness of about 5 to 100 μm, preferably about 10 to 85 μm, and more preferably about 15 to 75 μm. The second, stiffer or higher modulus, layer generally is constructed to be thinner than a first layer that has a more flexible, lower modulus. The first layer generally only needs to be sufficiently thick to provide an adequate seal to the seal surface.

When mounted on a valve seat, a multi-layered flexible flap can provide a unidirectional fluid valve with a lower pressure drop. The pressure drop may be determined in accordance with the Pressure Drop Test set forth below. The pressure drop across the valve at a flow rate of 85 liters per minute (L/min), may be less than about 50 Pascals (Pa), and may be less than 40 Pa, and still may be less than 30 Pa. At flow rates of 10 L/min, multi-layered flexible flaps may enable the inventive unidirectional fluid valve to have a pressure drop of less than 30 Pa, preferably less than 25 Pa, and more preferably less than 20 Pa. Pressure drops of about 5 to 50 Pa may be obtainable between flow rates of 10 L/min and 85 L/min using multi-layer flexible flaps in accordance with the present invention. In a preferred embodiment, the pressure drop may be less than 25 Pa over flow rates of 10 L/min to 85 L/min. If a flat valve seat is employed such as shown in FIG. 5, the pressure drop may be even less than 5 Pa at flow rates of 10 L/min.

The flexible flap shown in FIGS. 7 and 8 represent flaps that have an AB, ABA, or ABA' construction. Flaps used in the present invention may also have an ABC construction, where B is the layer that is stiffer and has a greater modulus of elasticity. While resistance to curl can be best achieved when the flexible flap has symmetry around the stiffer B layer, as in an ABA construction, in some instances, it may be preferred to use a flexible flap that has an ABC construction, where layer B is stiffer and has a greater modulus of elasticity than layers A and C. Layer C may, however, be stiffer than layer B, if desired, and thus be the stiffest of the three layers and may comprise a material that has a modulus of elasticity that is greater than both layers A and B. Layers A and C may be made from different materials and may have a different modulus of elasticity with respect to each other. For example, layer A may have a greater modulus of elasticity than layer C, or vice versa. Multi-layered flaps could feasibly have a greater than 3, 4, or 5 and up to 10, 20, or 100 layers. Multi-layered flaps that have perhaps one thousand layers ABABAB . . . AB, ABA'. . . BABA'BABA', or ABC . . . ABCABC could also be useful in conjunction with the present invention.

In a preferred embodiment, the layer that is the softer, more flexible (less stiff), and preferably has the lowest modulus of elasticity is disposed on the portion of the flexible flap that makes contact with the valve seat's seal surface. The inventors discovered that the use of a more flexible layer, and preferably a layer that has a lower modulus of elasticity, can allow a better seal to occur between the flexible flap and the seal surface under neutral conditions, that is, when a wearer is neither inhaling nor exhaling. It is therefore preferred—not only that the first layer of the flexible flap is disposed on the side of the flexible flap that faces the seal surface—but that the first layer directly contacts the seal surface when the flap is in the closed position.

In addition to the primary layers of the flexible flap, namely layers AB, ABA, ABA', or ABC, there may be additional layers disposed between these layers in accordance with the present invention. For example, primer layers, or layers that assist in adhering the different layers together, may be present between the layers. Additionally, protective coatings may be applied to the outer layers to address moisture or weathering issues. Thus, although it is preferred that the softer, more flexible layer be in contact with the seal surface, which layer may have the lower modulus of elasticity, there may be other layers such as the thin or thinner layers described above, that may be disposed between the first layer and the seal surface when the flap is resting on it. The presence of such layers, however, may be more or less incidental to the overall functioning of the flap. Generally such additional layers would not be as thick as layers A, A', B, and C, and typically would be substantially thinner such as, for example, 80%–99.9% thinner than the major layers A, A', B, and C.

Presently, the exhalation valve that is described in U.S. Pat. Nos. 5,325,892 and 5,509,436 to Japuntich et al. is believed to be a superior performing commercially available exhalation valve for use on a filtering face masks. Valves of the present invention, however, may be capable of exceeding the performance criteria for leak rate, valve opening pressure drop, and pressure drop across the valve under various flow rates. These parameters may be measured using the Leak Rate Test and Pressure Drop Test described below.

The Leak Rate is a parameter that measures the ability of the valve to remain closed under neutral conditions. The Leak Rate test is described below in detail but generally measures the amount of air that can pass through the valve at an air pressure differential of 1 inch water (249 Pa). Leak rates range from 0 to 30 cubic centimeters per minute ($cm^3$/min) at 249 Pa pressure, with lower numbers indicating better sealing. Using a filtering face mask of the present invention, leak rates that are less than or equal to 30 $cm^3$/min can be achieved in accordance with the present invention. Preferably, leak rates less than 10 $cm^3$/min, more preferably less than 5 $cm^3$/min may also be achieved. Exhalation valves that have been fashioned in accordance with the present invention may demonstrate a leak rate in the range of about 1 to 10 $cm^3$/min.

The valve opening pressure drop measures the resistance to the initial lifting of the flap from the valve's seal surface. This parameter may be determined as described below in the Pressure Drop Test. Typically, the valve opening pressure drop at 10 L/min is less than 30 Pa, preferably less than 25 Pa, and more preferably less than 20 Pa when testing a valve in accordance with the Pressure Drop Test described below. Typically, the valve opening pressure drop is about 5 to 30 Pa at 10 L/min when testing a valve in accordance with the Pressure Drop Test described below.

Examples of materials from which the first layer of the flexible flap may be made, include those that would promote a good seal between the flexible flap and the valve seat. These materials may generally include elastomers, both thermoset and thermoplastic; and thermoplastic/plastomers.

Elastomers, which may be either thermoplastic elastomers or crosslinked rubbers, may include rubber materials such as polyisoprene, poly (styrene-butadiene) rubber, polybutadiene, butyl rubber, ethylene-propylene-diene rubber, ethylene-propylene rubber, nitrile rubber, polychloroprene rubber, chlorinated polyethylene rubber, chlorosulphonated polyethylene rubber, polyacrylate elastomer, ethylene-acrylic rubber, fluorine containing elastomers, silicone rubber, polyurethane, epichlorohydrin rubber, propylene oxide rubber, polysulphide rubber, polyphosphazene rubber, and latex rubber, styrene-butadiene-styrene block copolymer elastomer, styrene-ethylene/butylene-styrene block copolymer elastomer, styrene-isoprene-styrene block copolymer elastomer, ultra low density polyethylene elastomer, copolyester ether elastomer, ethylene methyl acrylate elastomer ethylene vinyl acetate elastomer, and polyalphaolefin elastomers. Blends or mixtures of these materials may also be used.

Examples of some commercially available polymeric materials that may be used for the first (or more flexible) layer of the flap include:

TABLE 1

| Polymer Type | Source | Product Designator | Published Elastic Modulus (MPa) |
|---|---|---|---|
| Anhydride modified ethylene acrylate copolymer | Dupont Packaging and Industrial Polymers, Wilmington, DE | Bynel CXA 2174 | |
| Ethylene Vinyl Acetate Copolymer | E. I. Dupont Co., Wilmington, DE | Elvax 260 | |
| Ethylene-Methyl Acrylate Copolymer | Eastman Chemical Co., Kingsport, TN | EMAC SP2220 | |
| Polyethylene | Dupont/Dow Elastomers, Wilmington, DE | Engage 8200 | 2.76 @ 100% elongation |
| Polyethylene | Dupont/Dow Elastomers, Wilmington, DE | Engage 8550 | |
| Styrene-Butadiene-Styrene block copolymer | Atofina, Houston, TX | Finaprene 502 | |
| Styrene-Ethylene/Butylene-Styrene block copolymer | Kraton Elastomers, Belpre, Ohio | Kraton G1657 | 2.41 @ 300% elongation |
| Thermoplastic elastomer | QST Inc., St. Albans, VT | Monprene 1504 | 2.76 @ 300% elongation |
| Thermoplastic elastomer | Advanced Elastomers, Akron, Ohio | Santoprene 121-58 W175 | 2.1 @ 100% elongation |
| Ionomer Resin | E. I. Dupont Co., Wilmington, DE | Surlyn 1650 | |
| Thermoplastic elastomer | Advanced Elastomers, Akron, Ohio | Vistaflex 641 | 1.6 @ 100% elongation |

Elongations percentages were selected to best match the flattened portion of the stress-strain curve for a given material.

Examples of materials from which the second stiffer layer of the flexible flap may be made include highly crystalline materials such as ceramics, diamond, glass, zirconia; metals/foils from materials such as boron, brass, magnesium alloys, nickel alloys, stainless steel, steel, titanium, and tungsten. Polymeric materials that may be suitable include thermoplastics such as copolyester ether, ethylene methyl acrylate polymer, polyurethane, acrylonitrile-butadiene styrene polymer, high density polyethylene, high impact polystyrene, linear low density polyethylene, polycarbonate, liquid crystal polymer, low density polyethylene, melamines, nylon, polyacrylate, polyamide-imide, polybutylene terephthalate, polycarbonate, polyetheretherketone, polyetherimide, polyethylene napthalene, polyethylene terephthalate, polyimide, polyoxymethylene, polypropylene, polystyrene, polyvinylidene chloride, and polyvinylidene fluoride. Naturally-derived cellulosic materials such as reed, paper, and woods like beech, cedar, maple, and spruce may also be useful. Blends, mixtures, and combinations of these materials may too be used, including blends with the polymers described as being useful in the more flexible A, A' layer(s). Although the same or similar polymeric materials may be used in both the A, A' and B layers, the polymeric materials may be processed differently or include other ingredients to create a difference in stiffness.

Examples of some commercially available materials for the second stiffer layer include:

TABLE 2

| Polymer Type | Source | Product Designator | Published Elastic Modulus (MPa) |
|---|---|---|---|
| Nylon 11 | Elf Atochem, Philadelphia, PA | Besno P40 TL | 320 |
| Nylon 11 | Elf Atochem, Philadelphia, PA | Besno TL | 1300 |
| Copolyester Ether | Eastman Chemical Co., Kingsport, TN | Ecdel 9966 | 110 |
| Ethylene-Methyl Acrylate Copolymer | Eastman Chemical Co., Kingsport, TN | EMAC SP2220 | |
| Polycarbonate | Bayer AG, Pittsburgh, PA | Makrolon 3108 | 2413 |
| Poly (ethylene terephthalate) | E. I. Dupont Co., Wilmington, DE | Mylar 50 CL | 3790 |
| Polypropylene | Atofina, Deerpark, TX | Polypropylene 3576 | |

Preferably, all major layers A, A', B' and C in the flap are made from polymeric materials. As the term is used in this document, "polymeric" means containing a polymer, which is a molecule that contains repeating units, regularly or irregularly arranged. The polymer may be natural or synthetic and preferably is organic.

If the flexible flap has an ABC construction, the third or C layer of the flexible flap may be made from materials that comprise any of the materials set forth above with respect to the first layer as long as they are substantially different from the materials used in the A layer. The term "substantial" in this context means that the layer has a significantly different stiffness from layer A, and preferably a different elastic modulus, which would cause the flap to perform noticeably different from a flap that had, for example, an ABA or an ABA' construction. For certain polymeric materials, simple variation in material morphology may be sufficient to provide the required mechanical dissimilarity between the layers A, B, A', and C.

The multi-layer construction may or may not be continuous or uniform throughout the flexible flap; it may be present only in zones or vary in position within the flexible flap. For example, where the first layer A is in contact with the seal surface, it may only be juxtaposed on layer B in those areas where A makes contact with the seal surface. Alternatively, the A layer may be continuous whereas the B layer is discontinuous. The flexible flap thus may be fashioned in a variety of shapes and configurations. The flap could be circular, elliptical, rectangular, or a combination of such shapes, including, for example, the shapes shown in U.S. Pat. Nos. 5,325,892 and 5,509,436 to Japuntich et al. and shown in U.S. patent application Ser. Nos. 09/888,943 and 09/888,732 to Mittelstadt et al.

The multi-layer construction may or may not have oriented layers, either in its entirety or in part. For example, the B layer may be oriented with the A layers being unoriented. Alternatively, both the A and B layers may be oriented in the same direction or in different, cross, or opposing directions.

Flexible flaps that are used in connection with the present invention may be made through a co-extrusion process where as few as two layers, or as many as a thousand layers, of material are extruded simultaneously to form a single sheet. The co-extrusion of two materials, in two or three layers, has been found to carry particular utility in forming flaps of the present invention. See U.S. Pat. No. 3,557,265 to Chisholm et al. for an example of a method of extruding laminates. Other processes that could be utilized for manufacture of multi-layer flexible flaps or diaphragms may include controlled-depth cross linking with e-beam, electroplating, extrusion coating of a substrate, injection molding, lamination, solvent coating of a substrate, and vapor deposition onto a substrate.

The following Example has been selected for presentation here merely to further illustrate particular features and details of the invention. It is to be expressly understood, however, that while the Example serves this purpose, the particular details, ingredients, and other features are not to be construed in a manner that would unduly limit the scope of this invention.

TEST APPARATUS, TEST METHODS, AND EXAMPLE

Flow Fixture

Pressure drop testing is conducted on the valve with the aid of a flow fixture. The flow fixture provides air, at specified flow rates, to the valve through an aluminum mounting plate and an affixed air plenum. The mounting plate receives and securely holds a valve seat during testing. The aluminum mounting plate has a slight recess on its top surface that received the base of valve. Centered in the recess is a 28 millimeter (mm) by 34 mm opening through which air can flow to the valve. Adhesive-faced foam material may be attached to the ledge within the recess to provide an airtight seal between the valve and the plate. Two clamps are used to capture and secure the leading and rear edge of the valve seat to the aluminum mount. Air is provided to the mounting plate through a hemispherical-shaped plenum. The mounting plate is affixed to the plenum at the top or apex of the hemisphere to mimic the cavity shape and volume of a respiratory mask. The hemispherical-shaped plenum is approximately 30 mm deep and has a base diameter of 80 mm. Air from a supply line is attached to the base of the plenum and is regulated to provide the desired flow through the flow fixture to the valve. For an established air flow, air pressure within the plenum is measured to determine the pressure drop over the test valve.

Pressure Drop Test

Pressure drop measurements are made on a test valve using the Flow Fixture as described above. Pressure drop across a valve was measured at flow rates of 10, 20, 30, 40, 50, 60, 70, and 85 liters per minute. To test a valve, a test specimen is mounted in the Flow Fixture so that the valve seat is horizontally oriented at its base, with the valve opening facing up. Care is taken during the valve mounting to assure that there is no air bypass between the fixture and the valve body. To calibrate the pressure gauge for a given flow rate, the flap is first removed from the valve body and the desired airflow is established. The pressure gauge is then set to zero, bringing the system to calibration. After this calibration step, the flap is repositioned on the valve body and air, at the specified flow rate, is delivered to the inlet of the valve, and the pressure at the inlet is recorded. The valve-opening pressure drop (just before a zero-flow, flap opening onset point) is determined by measuring the pressure at the point where the flap just opens and a minimal flow is detected. Pressure drop is the difference between the inlet pressure to the valve and the ambient air.

Leak Rate Test

Leak rate testing for exhalation valves is generally as described in 42 CFR §82.204. This leak rate test is suitable for valves that have a flexible flap mounted to the valve seat. In conducting the Leak Rate Test, the valve seat is sealed between the openings of two ported air chambers. The two air chambers are configured so that pressurized air that is introduced into the lower chamber flows up through the valve into the upper chamber. The lower air chamber is equipped so that their internal pressures can be monitored during testing. An air flow gauge is attached to the outlet port of the upper chamber to determine air flow through the chamber. During testing, the valve is sealed between the two chambers and is horizontally oriented with the flap facing the lower chamber. The lower chamber is pressurized via an air line to cause a pressure differential, between the two chambers, of 249 Pa (25 mm $H_2O$; 1 inch $H_2O$). This pressure differential is maintained throughout the test procedure. Outflow of air from the upper chamber is recorded as the leak rate of the test valve. Leak rate is reported as the flow rate, in liters per minute, which results when an air pressure differential of 249 Pa is applied over the valve.

Valve Actuation Power

For a given valve port area (the area of the channel delivering air directly to the valve flap (in the Example, 8.55 $cm^2$)), the "actuation power" for a valve at a given flow rate can be determined for a range of flow rates by integrating the curve representing the flow rate (abscissa) in L/min and pressure drop (ordinate) in Pa, over a flow rate range of 10 to 85 L/min. Integration of the curve, represented graphically as the area under the curve, gives the power required to actuate a valve over a range of flows. The value for the integrated curve is defined as the Integrated Valve Activation Power (IVAP) in milliwatt (mW) units.

Valve Efficiency

A valve efficiency parameter may be calculated for valves using the results from the Pressure Drop Test, Leak Rate Test, and flap mass. Valve efficiency is determined from (1) the integrated valve actuation power in mW, (2) the leak rate recorded in $cm^3$/min, and (3) the weight of the flap in grams. Valve efficiency is calculated as follows:

$$VE=IVAP\times LR\times w$$

where: VE→valve efficiency

IVAP→integrated valve actuation power (milliwatts)

LR→leak rate (cubic centimeter per minute)

w→flap mass (grams)

VE is expressed in units of milliwatts•gram•cubic centimeters per minute or mW•g•$cm^3$/min. Lower valve efficiency values represent better valve performance. Valves of the present invention may be able to achieve VE values of about 2 to 20 mW•g $cm^3$/min, and more preferably less than about 10 mW•g $cm^3$/min.

Example 1

A multi-layer polymer sheet was made from two resins that were formed into a three-layer ABA construction using a solvent coating process. The first and third layers of the sheet, namely layers A and A, which provided outer major surface layers of the construction, were produced from an SBS(styrene-butadiene-styrene) rubber Finaprene™ 502 having an elastic modulus of 2 MPa supplied by Atofina Company, Houston, Tex. blended with 1% by weight Atmer™ 1759 supplied by Ciba Geigy, 540 White Plains, N.Y. 10591. The second middle layer B was a 36 micrometer thick polyester (PET) sheet that had an elastic modulus of 3790 MPa supplied by 3M Company. A solution of 25 parts Finaprene™ 502, dissolved in 75 parts of toluene with 0.25 part Atmer™ 1759, was prepared by first charging a vessel with 2500 g of Finaprene™ 502 followed by adding 7000 g of toluene at 21° C. This was stirred for 30 minutes using a stir blade to partially dissolve the Finaprene™ 502. Concurrently a solution of Atmer™ 1759 was prepared by adding 25 g of Atmer to the remainder 500 g of toluene desired for the final solution. This solution was again stirred at 60° C. for 30 minutes. These two solutions were then blended with each other and the subsequent solution, containing 24.9 weight % Finaprene™ 502, 74.8 weight % toluene, and 0.25 weight % Atmer™ 1759, was stirred with a stir blade for 3 hours at 21° C., followed by degassing with an aspirator. This degassed solution was then allowed to sit quiescently for 12 hours after stirring to ensure a homogeneous solution.

A 0.3 meter wide sheet of 36 micrometer thick polyester was coated on one side with the Finaprene™ 502 solution to a final dried thickness of 13 micrometers and 0.279 meters in width via a Hirano™ M-200L notch bar coater set to a gap of 89 micrometers. A line speed of 1 meter/min was employed so that the residence time of the coated film was 3 minutes in the 3 meter long oven, to ensure that the coating completely dried. Static charge was controlled via static strings at each idler roll on the coater as well as a deionizing bar just before the notched bar. The wound sheet, with one side coated was flipped over and was run through the same coating procedure just described to provide the final layer and a resultant three layer sheet that had a total thickness of 62 micrometers.

Flexible flaps were formed from the symmetrical ABA sheet by die cutting the multi-layer sheet to create a rectangular portion that had a semi-circular end (see FIG. 1, item 22). The overall length of the die-cut flap, including the semi-circular end, was about 3.25 cm, and the width of the flap was about 2.4 cm. The semi-circular end of the flap, in plan section, had a radius of 1.2 cm. The structural configuration of the flap is summarized in Table 3 below:

TABLE 3

| Layer Thickness (μm) | | Total Flap Thickness | Flap Length | Flap Width | Radius of Semicircular |
|---|---|---|---|---|---|
| A | B | (μm) | (cm) | (cm) | end (cm) |
| 13 | 36 | 62 | 3.25 | 2.4 | 1.2 |

To evaluate the performance of a valve incorporating this flap, the rectangular end of the flap was secured to a valve seat in a valve body. The valve body had a valve seat that had a concave curvature when viewed from a side elevation.

The configuration of the valve seat is described generally in U.S. Pat. Nos. 5,325,892 and 5,509,436 to Japuntich et al. and is used in a valve body employed in a commercially available face mask, model 8511, available from 3M Company, St. Paul, Minn. The valve body had circular orifice of 3.3 square centimeters ($cm^2$) disposed within the valve seat. To assemble a valve for evaluation, the valve flap was clamped to a flap-retaining surface that was about 4 millimeters (mm) long and that traversed the valve seat for a distance of about 25 mm. The curved seal ridge had a width of about 0.51 mm. The flexible flap remained in an abutting relationship to the seal ridge under neutral conditions, no matter how the valve was oriented. No valve cover was attached to the valve seat.

Stiffness Determined:

A Finaprene™ 502 sheet that contained 1% Atmer 1759 was prepared in exactly the same way as given in example one with the exception that this solution was coated onto a silicone release liner. Strips of 23.4 micrometer thick PET film were cut 0.794 cm wide. Likewise strips of the Finaprene™ 502 coated liner were cut 0.794 cm wide, with the liner included to facilitate cutting. Upon separating the Finaprene™ 502 film from the release liner, the film thickness measured was 24 micrometers thick, very close to the thickness of the PET.

A cantilever bending test was used to indicate stiffness of thin strips of material by measuring the bending length of a specimen under its own mass. A test specimen was prepared by cutting the 0.794 cm wide strips of material to approximately 5 cm lengths. The specimen was slid, in a direction parallel to its long dimension, over the 90° edge of a horizontal surface. After 1.5 cm of material was extended past the edge, the overhang of the specimen was measured as the vertical distance from the end of the strip to the horizontal surface. The overhanging distance of the specimen divided by its extended length was reported as the cantilever bend ratio. A cantilever bend ratio approaching 1 would indicate a high level of flexibility where a material with a bend ratio approaching 0 would be stiff.

TABLE 4

| Material | Film Thickness (micrometer) | Cantilever Bend Ratio |
|---|---|---|
| Layer 1 | 24 | 0.95 |
| Layer 2 | 23 | 0.26 |

Layer 1 - Finaprene ™ 502 film, containing 1% Atmer 1759.
Layer 2 - PET film of the same composition as Example 1.

The data set forth in Table 4 shows that the second layer is very stiff, relative to the first layer even though it is slightly not as thick.

Comparative Example 1

A valve, with its outer protective cover removed, from a commercially available 8511™ N95 respirator available from 3M Company, St. Paul, Minn. was evaluated using the test procedures described above. The valve seat that was used was the same as the valve seat used in Example 1. The flexible flap had a monolithic construction, which was the same as the flaps used in the commercially available 8511 ™ 3M mask. The flap was composed of polyisoprene. The flexible flap had the same dimensions as the flap used in Example 1 and had a material density of 1.08 grams per cubic centimeter (g/cm$^3$).

Figure 9:
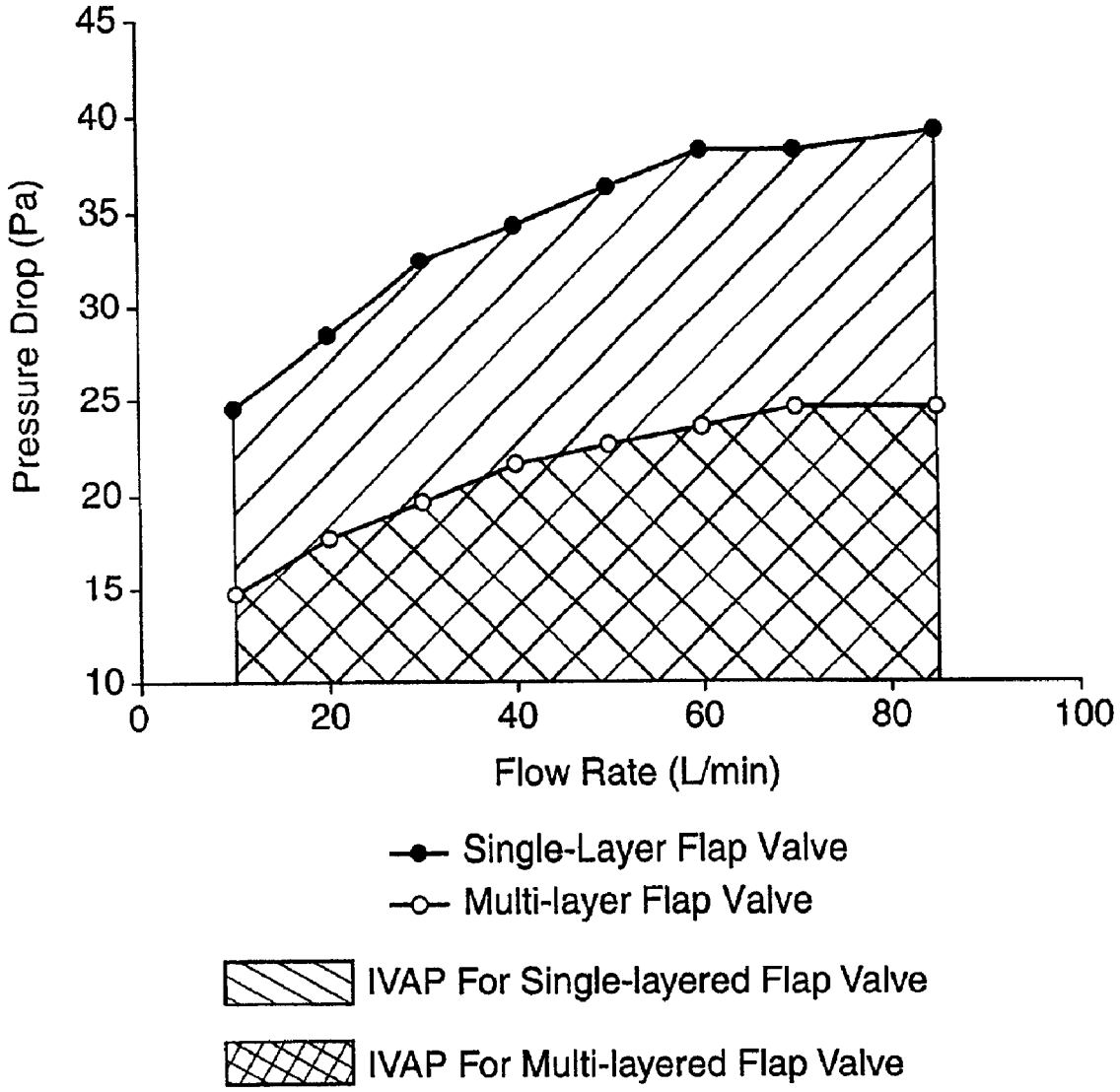
FIG. 9 is a graph that plots Pressure Drop versus Flow Rate for a valve that uses a multi-layered flap according to the present invention and a known commercially available valve.

Leak Rate Test and Pressure Drop Test evaluations were also conducted on the inventive valve and the comparative valve. The values for the Pressure Drop are shown in FIG. 9. The Flap Mass, Leak Rate, Valve Efficiency, and Integrated Flap Activation Power are given below in Table 5. The valves represent the average of three test specimens for both the Example and the Comparative Example.

TABLE 5

| Valve | Flap Mass (g) | Leak Rate (cm$^3$/min) | Integrated Flap Actuation Power (mW) | Valve Efficiency (mW g · cm$^3$/min) |
|---|---|---|---|---|
| Multi-layered flap valve | 0.053 | 5.0 | 30 | 8 |
| Single layer flap valve | 0.279 | 5.7 | 48 | 76 |

The data, set forth in Table 5 and depicted in FIG. 9, show that a valve or face mask that employs the inventive technology requires significantly less (37% less) power to actuate, when compared to a face mask that uses a valve that has a single layered construction, over a functional range of flow rates. For both the individual flow points and over the operational range of flow points, a reduction in valve actuation power is important in use because the wearer's breathing is what actuates the valve. The greater the actuation power, especially over the functional range of the valve, the more difficult it is for the wearer to breathe when the mask is worn. Over long wearing periods, where a user might take ten to twelve breaths per minute through the mask, the compounding of the power consumption to actuate the valve becomes an important physiological factor in terms of breathing comfort and worker satisfaction. A mask that is more easily vented, through a valve that requires less power to actuate, is more efficient in removing carbon dioxide and moisture, which further improves wearer comfort and makes it more likely that the wearer will keep the mask donned to their face when in a toxic environment.

The data set forth in Table 5 also demonstrate that the invention may afford a 850% Valve Efficiency improvement over a comparative valve when operating in the functional range typical for filtering face masks. Considering that the Valve Efficiency parameter accounts for the counter balancing effects of leakage, valve mass, and actuation power, this is a particularly significant result. A valve designed for use with a face mask that employs a single layer material construction may require, when considered on an equivalent design basis, a heavier flap to more tightly close the valve. A flap that has a tighter seal and greater mass requires more power to actuate. In terms of the Valve Efficiency parameter, the required increase in mass and actuation power, offsets any efficiency gains for reduced leak rate.

It is also evident that the gains in performance were made with minimal use of material, as depicted by the mass of the flaps, an indication of the economy achievable with valve flaps of the invention.

All of the patents, patent applications, and other documents cited above, including those in the Background section, are incorporated by reference into this document in total.

The present invention may be suitably practiced in the absence of any element not specifically described in this document.

What is claimed is:

1. A filtering face mask that comprises:

(a) a mask body that is adapted to fit at least over the nose and mouth of a wearer to create an interior gas space when worn; and (b) an exhalation valve that is in fluid communication with the interior gas space, the exhalation valve comprising:

(i) a valve seat that comprises a seal surface and an orifice through which exhaled air may pass to leave the interior gas space; and (ii) a flexible flap that is mounted to the valve seat such that the flap makes contact with the seal surface when the valve is in a closed position and such that the flap can flex away from the seal surface during an exhalation to allow exhaled air to pass through the orifice to ultimately enter an exterior gas space, the flexible flap comprising at least first and second juxtaposed layers, wherein at least one of the first and second layers is stiffer than the other layer.

2. The filtering face mask of claim 1, wherein the first and second layers comprise first and second materials, respectively, that each have a different modulus of elasticity.

3. The filtering face mask of claim 2, wherein the first layer is disposed closer to the seal surface than the second layer when the flap is positioned against the seal surface, and wherein the second layer has a greater modulus of elasticity than the first layer.

4. The filtering face mask of claim 3, wherein the first layer contacts the seal surface when the flap is positioned against the seal surface.

5. The filtering face mask of claim 3, wherein the flexible flap has a thickness of about 10 to 2,000 μm.

6. The filtering face mask of claim 3, wherein the flexible flap has a thickness of about 20 to 700 μm.

7. The filtering face mask of claim 3, wherein the flexible flap has a thickness of about 25 to 600 μm.

8. The filtering face mask of claim 3, wherein the first layer has a thickness of about 5 to 700 μm, and wherein the second layer has a thickness of about 5 to 100 μm.

9. The filtering face mask or claim 3, wherein the first layer has a thickness of about 10 to 600 μm, and wherein the second layer has a thickness of about 10 to 85 μm.

10. The filtering face mask of claim 3, wherein the first layer has a thickness of about 12 to 500 μm, and wherein the second layer has a thickness of about 15 to 75 μm.

11. The filtering face mask of claim 3, wherein a pressure drop across the valve at a flow rate of 85 liters per minute is less than about 50 Pascals.

12. The filtering face mask of claim 3, wherein a pressure drop across the valve at a flow rate or 85 liters per minute is less than about 40 Pascals.

13. The filtering face mask of claim 3, wherein a pressure drop across the valve at a flow rate of 85 liters per minute is less than about 30 Pascals.

14. The filtering face mask of claim 3, wherein a pressure drop across the valve at a flow rate of 10 liters per minute is less than 30 Pascals.

15. The filtering face mask of claim 3, wherein a pressure drop across the valve at a flow rate of 10 liters per minute is less than 30 Pascals.

16. The filtering face mask of claim 3, wherein a pressure drop across the valve at a flow rate of 10 liters per minute is less than 25 Pascals.

17. The filtering face mask of claim 3, wherein a pressure drop across the valve at a flow rate of 10 liters per minute is less than 20 Pascals.

18. The filtering face mask of claim 3, wherein a pressure drop across the valve is about 5 to 50 Pascals between flow rates of 10 liters per minute and 85 liters per minute.

19. The filtering face mask of claim 3, wherein a pressure drop across the valve is about 5 to 25 Pascals between flow rates of 10 liters per minute and 85 liters per minute.

20. The filtering face mask of claim 3, wherein the first layer contains a rubber, and wherein the second layer contains polyethylene terephthalate or polycarbonate.

21. The filtering face mask of claim 20, wherein rubber is a styrene-butadiene-styrene block copolymer.

22. The filtering face mask of claim 1, wherein the exhalation valve is mounted to the mask body.

23. The filtering face mask of claim 1, which is a negative pressure half-mask that has a fluid-permeable mask body that contains a layer of filter material.

24. The filtering face mask of claim 1, wherein the exhalation valve is a flapper-style exhalation valve.

25. The filtering face mask of claim 24, wherein the flapper-style exhalation valve has a planar seal surface.

26. The filtering face mask of claim 25, wherein the flexible flap is not pressed against the seal surface under neutral conditions.

27. The filtering face mask of claim 26 wherein a pressure drop is less than 5 Pascals at flow rates of 10 liters per minute.

28. The filtering face mask of claim 1, wherein the flexible flap includes a third layer that has substantially the same stiffness as the first layer.

29. The filtering face mask or claim 28, wherein the flexible flap exhibits symmetry with respect to the second layer, and wherein the second layer is stiffer than the first and third layers.

30. The filtering face mask of claim 1, wherein the second layer has a modulus of elasticity that is greater than the first layer, and wherein the first layer contacts the seal surface when the flap is positioned against the seal surface.

31. The filtering face mask of claim 30, wherein the modulus of elasticity of the first layer is about 0.15 to 10 megaPascals, and wherein the modulus of elasticity of the second layer is about 2 to $1.1\times10^6$ megaPascals.

32. The filtering face mask of claim 30, wherein the modulus of elasticity of the first layer is preferably about 1 to 7 megaPascals, and wherein the modulus of elasticity of the second layer is about 200 to 11,000 megaPascals.

33. The filtering face mask of claim 32, wherein the second layer has a modulus of elasticity of 300 to 5000 megaPascals.

34. The filtering face mask of claim 1, wherein the second layer is stiffer than the first layer, and wherein the moduli ratio between the first layer and the second layer is less than 1.

35. The filtering face mask of claim 1, wherein the second layer is stiffer than the first layer, and wherein the moduli ratio between the first layer and the second layer is less than 0.01.

36. The filtering face mask of claim 1, wherein the second layer is stiffer than the first layer, and wherein the moduli ratio between the first layer and the second layer is less than 0.01.

37. The filtering face mask of claim 1, wherein the exhalation valve includes a third layer such that the flap has an ABA construction, wherein the B layer is stiffer than the A layers.

38. The filtering face mask of claim 1, wherein the exhalation valve includes a third layer such that the flap has an ABA' construction, wherein the B layer is stiffer than the A and A' layers, and wherein the A layer is located closer to the seal surface than the B layer.

39. The filtering face mask of claim 1, wherein the exhalation valve includes a third layer such that the flap has an ABC construction, wherein the B layer is stiffer than the A layers, and wherein the A layer is located closer to the seal surface than the B layer.

40. The filtering face mask of claim 1, wherein the exhalation valve includes a third layer such that the flap has an ABC construction, wherein the C layer is stiffer than the A and B layers, and is located closer to the seal surface than the A and B layers.

41. The filtering face mask of claim 1, wherein the first and second layers both contain polymer materials.

42. The filtering face mask of claim 41, wherein the first layer is disposed closer to the seal surface than the second layer when the flap is positioned against the seal surface, and wherein the second layer has a greater modulus of elasticity than the first layer.

43. The filtering face mask of claim 42, wherein the first layer contacts the seal surface when the flap is positioned against the seal surface.

44. The filtering face mask of claim 42, wherein the flexible flap has a thickness of about 10 to 2,000 μm.

45. The filtering face mask of claim 42, wherein the flexible flap has a thickness of about 20 to 700 μm.

46. The filtering face mask of claim 42, wherein the flexible flap has a thickness or about 25 to 600 μm.

47. The filtering face mask of claim 42, wherein the first layer has a thickness of about 5 to 700 μm, and wherein the second layer has a thickness of about 5 to 100 μm.

48. The filtering face mask of claim 42, wherein the first layer has a thickness of about 10 to 600 μm, and wherein the second layer has a thickness of about 10 to 85 μm.

49. The filtering face mask of claim 42, wherein the first layer has a thickness of about 12 to 500 μm, and wherein the second layer has a thickness of about 15 to 75 μm.

50. The filtering face mask of claim 42, wherein a pressure drop across the valve at a flow rate of 85 liters per minute is less than about 50 Pascals.

51. The filtering face mask of claim 42, wherein a pressure drop across the valve at a flow rate of 85 liters per minute is less than about 40 Pascals.

52. The filtering face mask of claim 42, wherein the pressure drop across the valve at a flow rate of 85 liters per minute is less than about 30 Pascals.

53. The filtering face mask of claim 42, wherein the pressure drop across the valve had a flow rate of 10 liters per minute is less than 30 Pascals.

54. The filtering face mask of claim 42, wherein the pressure drop across the valve had a flow rate of 10 liters per minute is less than 30 Pascals.

55. The filtering face mask of claim 42, wherein the pressure drop across the valve had a flow rate of 10 liters per minute is less than 25 Pascals.

56. The filtering face mask of claim 42, wherein the pressure drop across the valve had a flow rate of 10 liters per minute is less than 20 Pascals.

57. The filtering face mask of claim 42, wherein the pressure drop across the valve is about 5 to 50 Pascals between flow rates of 10 liters per minute and 85 liters per minute.

58. The filtering face mask of claim 42, wherein the pressure drop across the valve is about 5 to 25 Pascals between flow rates of 10 liters per minute and 85 liters per minute.

59. The filtering face mask of claim 1, wherein the exhalation valve exhibits a valve efficiency of about 2 to 20 mW•g $cm^3$/min.

60. The filtering face mask of claim 1, wherein the exhalation valve exhibits a valve efficiency of about 2 to 10 mW•g $cm^3$/min.

61. The filtering face mask of claim 1, wherein the first and second juxtaposed layers are both disposed on the flexible flap in the region where the flap bends when the flap flexes away from the seal surface during an exhalation.

62. The filtering face mask of claim 1, wherein the stiffer layer is disposed on the flap in the region where the flap bends when the flap flexes away from the seal surface during exhalation.

63. A filtering face mask that comprises:

(a) a mask body that is adapted to fit at least over the nose and mouth of a wearer to create an interior gas space when worn; and (b) an exhalation valve that is in fluid communication with the interior gas space, the exhalation valve comprising:

(i) a valve seal that comprises a seal surface and an orifice through which exhaled air may pass to leave the interior gas space; and (ii) a flexible flap that is mounted to the valve seal such that the flap makes contact with the seal surface when the valve is in a closed position and such that the flap can flex away from the seal surface during an exhalation to allow exhaled air to pass through the orifice to ultimately enter an exterior gas space, the flexible flap comprising at least first and second juxtaposed layers, wherein at least one of the layers has a greater modulus of elasticity than the other layer.

64. The filtering face mask of claim 63, wherein the exhalation valve is mounted to the mask body.

65. The filtering face mask of claim 64, which is a negative pressure half-mask that has a fluid-permeable mask body that contains a layer of filter material.

66. The filtering face mask of claim 63, wherein the exhalation valve is a flapper-style exhalation valve.

67. The filtering face mask of claim 66, wherein the flapper-style exhalation valve has a planar seal surface.

68. The filtering face mask of claim 67 wherein the pressure drop is less than 5 Pascals at flow rates of 10 liters per minute.

69. The filtering face mask of claim 66, wherein the flexible flap is not pressed against the seal surface under neutral conditions.

70. The filtering face mask of claim 63, wherein the flexible flap includes a third layer that has substantially the same modulus of elasticity as the first layer.

71. The filtering face mask of claim 70, wherein the flexible flap exhibits symmetry with respect to the second layer, and wherein the second layer is stiffer than the first and third layers.

72. The filtering face mask of claim 63, wherein the second layer has a modulus of elasticity that is greater than the first layer, and wherein the first layer contacts the seal surface when the flap is positioned against the seal surface.

73. The filtering face mask of claim 72, wherein the modulus of elasticity of the first layer is about 1.15 to 10 megaPascals, and wherein the modulus of elasticity of the second layer is about 2 to $1.1\times10^6$ megaPascals.

74. The filtering face mask of claim 72, wherein the modulus of elasticity of the first layer is about 2 to 5 megaPascals, and wherein the modulus of elasticity of the second layer is about 200 to 11,000 megaPascals.

75. The filtering face mask of claim 74, wherein the second layer has a modulus of elasticity of 300 to 500 megaPascals.

76. The filtering face mask of claim 63, wherein the second layer has a greater modulus of elasticity than the first layer, and wherein the moduli ratio between the first layer and the second layer is less than 1.

77. The filtering face mask of claim 63, wherein the second layer has a greater modulus of elasticity than the first layer, and wherein the moduli ratio between the first layer and the second layer is less than 0.01.

78. The filtering face mask of claim 63, wherein the second layer has a greater modulus of elasticity than the first layer, and wherein the moduli ratio between the first layer and the second layer is less than 0.001.

79. The filtering face mask of claim 63, wherein the exhalation valve includes a third layer such that the flap has an ABA construction, wherein the B layer is stiffer than the A layers.

80. The filtering face mask of claim 63, wherein the exhalation valve includes a third layer such that the flap has an ABC construction, wherein the B layer is stiffer than the A layers, and wherein the A layer is located closer to the seal surface than the layer.

81. The filtering face mask of claim 63, wherein the exhalation valve includes a third layer such that the flap has an ABA' construction, wherein the B layer is stiffer than the A layers and wherein the A layer is located closer to the seal surface than the B layer.

82. The filtering face mask of claim 63, wherein the exhalation valve includes a third layer such that the flap has an ABC construction, wherein the C layer is stiffer than the A and B layers, and is located closer to the seal surface than the A and B layers.

83. The filtering face mask of claim 63, wherein the exhalation valve exhibits a valve efficiency of about 2 to 20 mW•g $cm^3$/min.

84. The filtering face mask of claim 63, wherein the exhalation valve exhibits a valve efficiency of about 2 to 0 mW•g $cm^3$/min.

85. The filtering face mask of claim 63, wherein the first and second juxtaposed layers are both disposed on the flexible flap in the region where the flap bends when the flap flexes away from the seal surface during an exhalation.

86. The filtering face mask of claim 63, wherein the stiffer layer is disposed on the flap in the region where the flip bends when the flap flexes away from the seal surface during exhalation.

* * * * *

UNITED STATES PATENT AND TRADEMARK OFFICE

CERTIFICATE OF CORRECTION

PATENT NO. : 7,028,689 B2
APPLICATION NO. : 09/989965
DATED : April 18, 2006
INVENTOR(S) : Martin, Philip G.

It is certified that error appears in the above-identified patent and that said Letters Patent is hereby corrected as shown below:

Column 1
Line 7, after "valve" delete "," and after "or" insert --in--.
Line 27, after "warm," insert --moist,-- and after "exhaled" delete "moist,".
Line 34, delete "manufacture" and insert --manufactures of-- therefore.
Line 35, after "have" delete "used".
Line 36, after "masks" insert --to-- therefore.

Column 3
Line 40, after "mode" delete"." and insert --;-- therefore.

Column 5
Line 11, delete "worm." and insert --worn.-- therefore.
Line 42, delete "No." and insert -- Nos. --, therefore.

Column 6
Line 8, delete "see" and insert --see U.S. Pat. No --, therefore.
Line 58, delete "poly4" and insert --poly-4--, therefore.

Column 9
Line 43, delete "5000®" and insert --5000™--, therefore and delete "6000®" and insert --6000™--, therefore..
Line 66, delete "flowstream" and insert --flow stream--, therefore.

Column 11
Line 37, delete "mega Pascals" and insert --megaPascals--, therefore.
Line 39, delete "$x^6$" and insert --x $10^6$--, therefore.

UNITED STATES PATENT AND TRADEMARK OFFICE

CERTIFICATE OF CORRECTION

PATENT NO. : 7,028,689 B2
APPLICATION NO. : 09/989965
DATED : April 18, 2006
INVENTOR(S) : Martin, Philip G.

It is certified that error appears in the above-identified patent and that said Letters Patent is hereby corrected as shown below:

Column 21
Line 22, in Claim 12, delete "or" and insert --of--, therefore.

Column 22
Line 1, in Claim 29, delete "or" and insert --of--, therefore.
Line 30, in Claim 36, delete "0.01" and insert --0.001--, therefore.
Line 14, after "is" delete "preferably".
Line 64, in Claim 46, delete "or" and insert --of--, therefore.

Column 23
Line 55, in Claim 63, delete "seal" and insert --seat--, therefore.
Line 58, in Claim 63, delete "seal" and insert --seat--, therefore.

Column 24
Line 27, in Claim 73, delete "1.15" and insert -- 0.15 --, therefore.
Line 57, in Claim 80, after "the" insert -- B --.
Line 61, in Claim 81, delete "layers" and insert -- layers, --, therefore.

Column 26
Line 4, in Claim 86, delete "flip" and insert -- flap --, therefore.

Signed and Sealed this

Eighteenth Day of July, 2006

JON W. DUDAS
*Director of the United States Patent and Trademark Office*